United States Patent [19]

Heinbuchner

[11] Patent Number: 4,633,641

[45] Date of Patent: Jan. 6, 1987

[54] METHOD FOR MOUNTING SKELETONS OF SUPERSTRUCTURES AND JIG FOR IMPLEMENTING SUCH METHOD

[75] Inventor: Johann Heinbuchner, Attnang-Puchheim, Austria

[73] Assignee: Doubrava KG, Austria

[21] Appl. No.: 545,377

[22] PCT Filed: Jan. 19, 1983

[86] PCT No.: PCT/EP83/00014

§ 371 Date: Nov. 2, 1983

§ 102(e) Date: Nov. 2, 1983

[87] PCT Pub. No.: WO83/02634

PCT Pub. Date: Aug. 4, 1983

[30] Foreign Application Priority Data

Jan. 22, 1982 [CH] Switzerland ..... 398/82

[51] Int. Cl.[4] ..... E04B 1/348; E04G 21/18

[52] U.S. Cl. ..... 52/747; 52/79.1; 52/749

[58] Field of Search ..... 52/747, 749, 648, 637, 52/651, 236.3, 646, 79.1, 79.5, 83

[56] References Cited

U.S. PATENT DOCUMENTS 3,977,147 8/1976 Fletcher et al. ..... 52/236.3
4,443,992 4/1984 Shechter ..... 52/79.1 X

FOREIGN PATENT DOCUMENTS 2511271 9/1976 Fed. Rep. of Germany .
690150 10/1979 U.S.S.R. .
763558 9/1980 U.S.S.R. .

*Primary Examiner*—J. Karl Bell
*Attorney, Agent, or Firm*—Ostrolenk, Faber, Gerb & Soffen

[57] ABSTRACT

Before being brought and fastened to the location of the building and before being connected to one another skeleton supports and ceiling beams of individual cell elements are orientated and preferably held together on a framework jig. For the skeleton supports and/or for the ceiling beams an orientation device, such as an opening accommodating the respective sleleton part, a peg penetrating the support or the like is foreseen.

A formwork jig with a railing which extends preferably over the entire inside space of the cell element serves to facilitate assembly of the ceiling beams. At least one supporting device is foreseen in the middle of the jig for the connection point of ceiling beams.

17 Claims, 10 Drawing Figures

METHOD FOR MOUNTING SKELETONS OF SUPERSTRUCTURES AND JIG FOR IMPLEMENTING SUCH METHOD

The invention relates to a process for assembling the skeleton of skeletal high buildings, especially structures consisting of individual cell elements with skeleton supports on the one hand, and ceiling beams comprising edge and/or radial beams on the other hand, expediently prior to bringing the cell elements and fastening them to the location of the building foreseen for this purpose, as well as to a framework jig to perform the process.

Processes of this type have become known e.g. from DE-ASen 1,684.724, 1,966.606 and 2,511.271, as well as from AT-PS 326.877. Here, cell elements of different floor plans as in the two literatures first cited can be understood, but the use of cell elements of hexagonal floor plan according to the third and fourth literatures cited is preferred. Especially with regard to the manufacture of individual cell elements prefabrication of the skeleton of skeletal high-building yields great advangages. It is the objective of the present invention to improve such a process further in the sense of work rationalization.

This objective is fulfilled by the present invention by at least a few parts of the skeleton being oriented prior to their connection to one another by means of a framework jig and preferably held fast.

As can be seen in the following description of embodiment examples a rationalization effect can already be achieved when using a two-dimensional jig. However, to conduct the process according to the present invention a three-dimensional framework jig is preferably used, wherein an orientation device such as an opening accommodating the respective skeleton part, a peg penetrating the support or the like, is foreseen for the skeleton supports and/or for the ceiling beams.

Further details relating to the invention are given in the following description of the embodiment examples shown schematically in the drawing. In this context:

FIG. 1 shows a front elevation of a framework jig which is shown in

FIG. 2 in plan view;

FIG. 2*a* is a fragmentary enlarged view of one of the corners of the structure of FIG. 2;

FIG. 3 shows the erection of the skeleton supports illustrated similar to FIG. 1

FIG. 3*a* is a fragmentary side elevation partly in section of one of the corners of the structure shown in FIG. 3;

Figure 1:
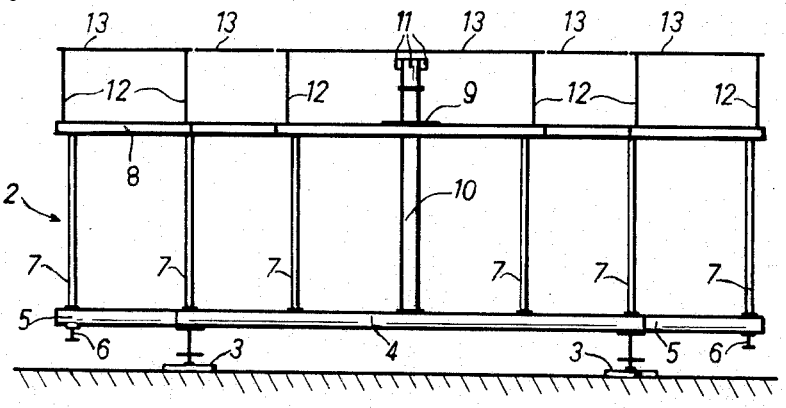
Figure 2:
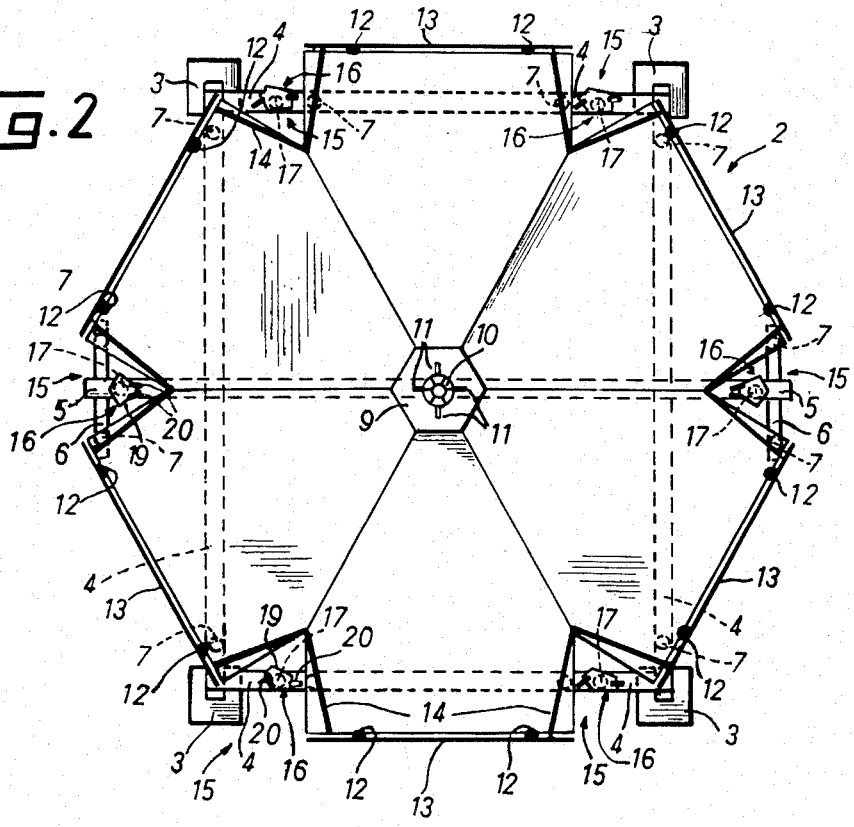
Figure 2A:
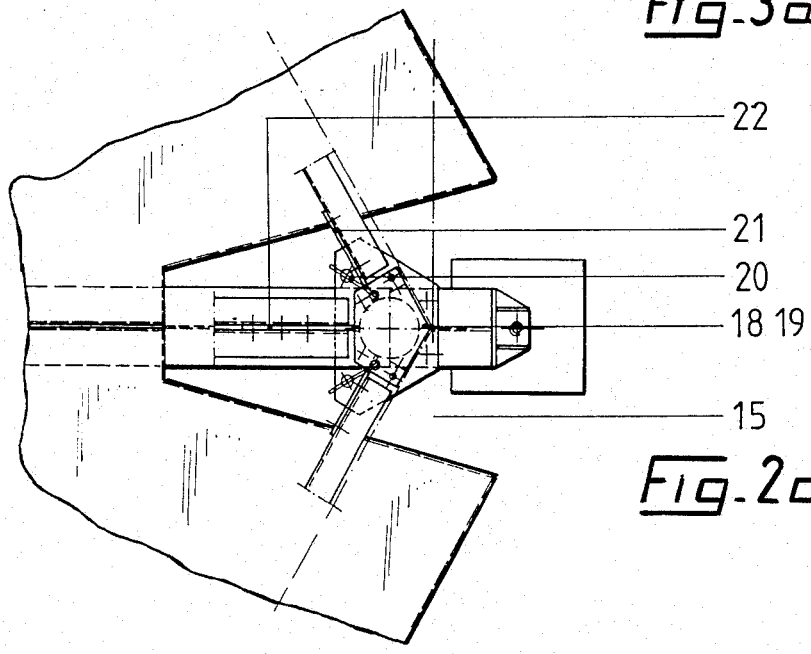
Figure 7:
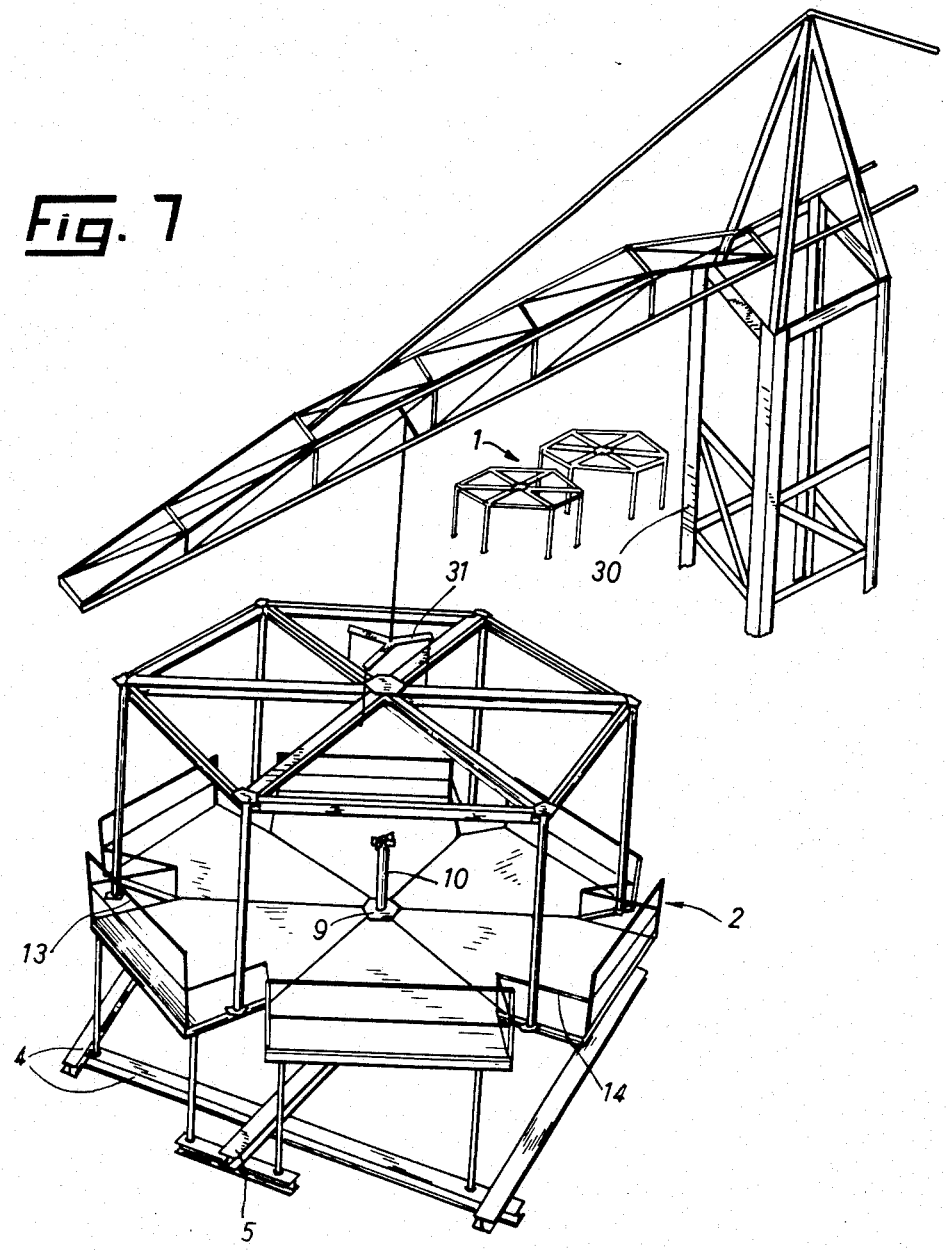
FIG. 7 shows the lifting of the finished skeleton of a cell element out of the framework jig by means of a crane.

At the beginning of the assembly of the skeleton 1 of a steel-skeleton high building shown in FIG. 7, a assembly framework 2 serving as an assembly jig is erected according to FIGS. 1 and 2. The framework jig 2 stands on 4 bases 3, which carry a frame formed by four beams 4. A through transverse beam 5 is attached to the frame formed by the beams 4, the ends of which are fitted with crossbars. Framework supports 7 which carry an assembly platform 8 are attached to the beams 4 and the crossbeams 6.

As can be seen in FIG. 2 the framework jig 8 consists of twelve similarly shaped elements arranged in pairs symmetrical to the axis which are joined together in the center by a hub 9. This hub 9 is fastened to a mast 10 supported on the transverse beam 5, said mast carrying the elements of the framework jig 8 on the inside above the hub 9, while on the outside a framework support 7 is allocated to each platform element. As will be explained below using FIG. 6 the upper end of the mast 10 serves as a support, for which reason it is fitted with four wings 11 to increase its supporting surface.

Each element pair of the framework jig 8 is furnished with a railing 13, each supported by two posts 12. According to FIG. 2 these railings 13 are arranged along the sides of an imagined hexagon and interconnected by means of a linking railing 14. As shown in FIG. 7 the railing linkages 14 are somewhat lower than the railings 13 and encompass a section 15 of the assembly platform 8. In the angular symmetric of these triangular sections 15 orientation devices 16 are arranged on the transverse beam 5 and on two of the four framework beams 4.

The orientation devices 16 serve to definitively preset the position of skeleton supports 17 (see FIG. 3) of a cell element of the skeletal high building 1 (see FIG. 7) to eliminate measuring work or the like. For this purpose the orientation devices 16 can be made e.g. from the base 18 (FIG. 3) of the sleeves accommodating the supports 17 or from the fitting peg penetrating into the hollow supports 17 from below. However, to facilitate the later removal of the finished cell skeleton (see FIG. 7) in the embodiment shown in FIGS. 1 and 2 projecting parts such as sleeves or pegs are avoided and only support discs 19 corresponding to the floor plan of one base 18 of the supports 17 are foreseen, on which the respective base 18 is released by clamping devices 20, whereupon the fininshed skeleton can be removed in the manner shown in FIG. 7.

Figure 3A:
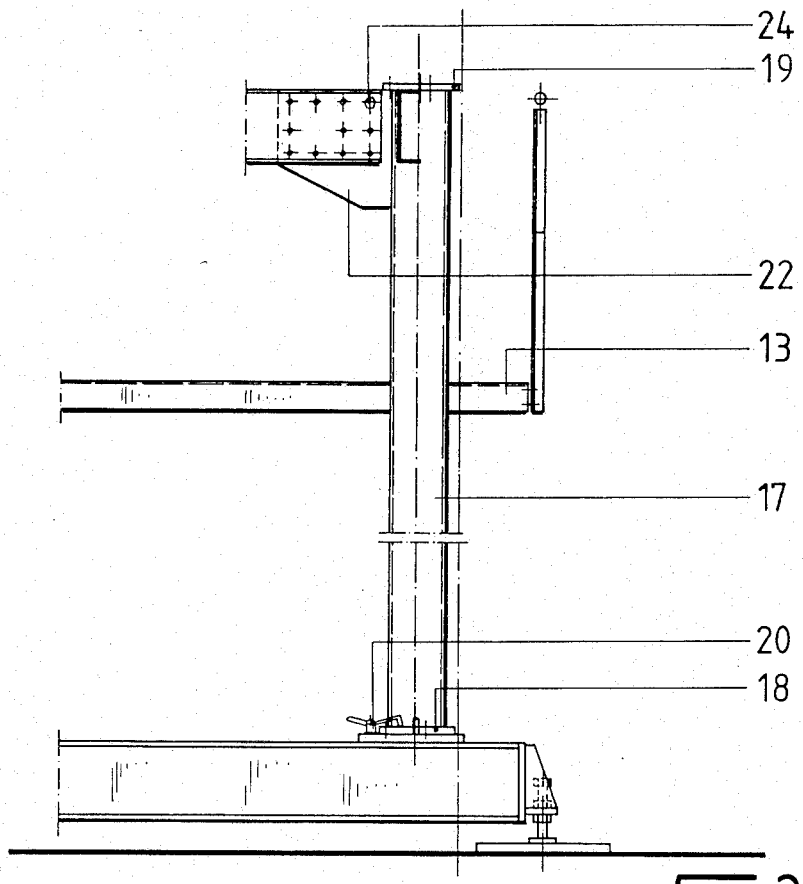
Figure 3:
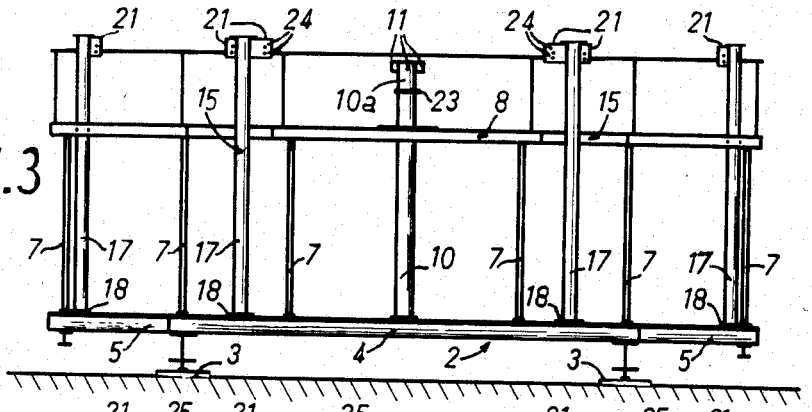
Figure 5:
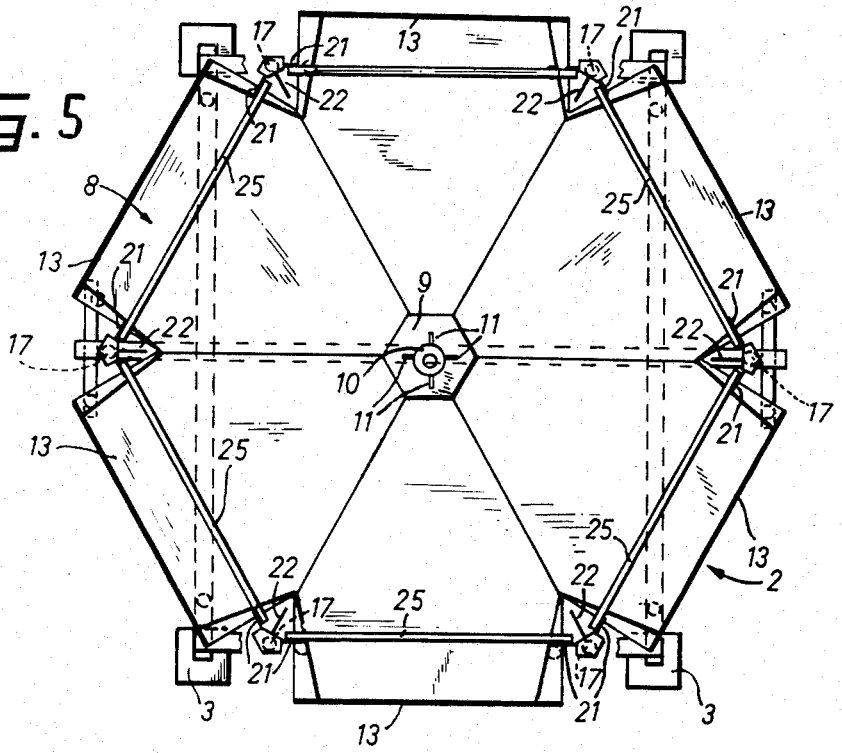

After completion of the framework jig 2 shown in FIGS. 1 and 2 and serving as a jig for setting the supports 17, the supports 17 are therefore placed on the tieplates 19 (FIG. 2) on the beams 4 and 5 in the manner shown in FIG. 3 and then clamped at their bases 18 (FIG. 3) with the aid of the clamping devices 20 (FIG. 2) On its upper end every skeleton support has two joining wings 21 at the side, forming an angle of 120 degrees to one another. As shown by FIG. 5 the supports 17 also have a further joining wing 22 facing the mast 10 which which lies in the angle symmetric between the two wings 21. The lower edge of the joining wings 21, 22 lies a little above the upper edge plane of the supporting wing 11. The reason for this is cited in the description to FIG. 6 which will be given later. In the case that a framework jig 2 is to be used for cell skeletons with supports 17 of different heights, the mast can be extended telescopically and locked at various heights. For example, the lower part of the mast 10 ends in a collar 23, and from this lower part an upper mast section 10*a* with the wings 11 is extendable or lockable with pins which can be inserted in holes of a row of holes extending along its length.

The joining wings 21, 22 are welded to the supports 17 and furnished with holes 24 for allowing the insertion of bolts or rivets. Hence, as soon as all supports 17 are set up for a hexagonal cell element in the manner as shown in FIGS. 3 and 5 on their places given by the orientation devices 16, only the edge beams 25 extending along the periphery need first be fastened by means of the bolts or rivets inserted in the holes 24. In principle it would also be possible to fasten the ceiling beams 27 to the joining wings 22 according to FIG. 6, but it has proven to be expedient to begin with the attachment of the edge beams 25. As shown in FIG. 5 the individual elements of the assembly platforms 8 are long enough to allow for sufficient space between the railing 13 and the edge beams 25, so that for the assembly of the latter access can be found to the connection points from both sides.

Figure 4:
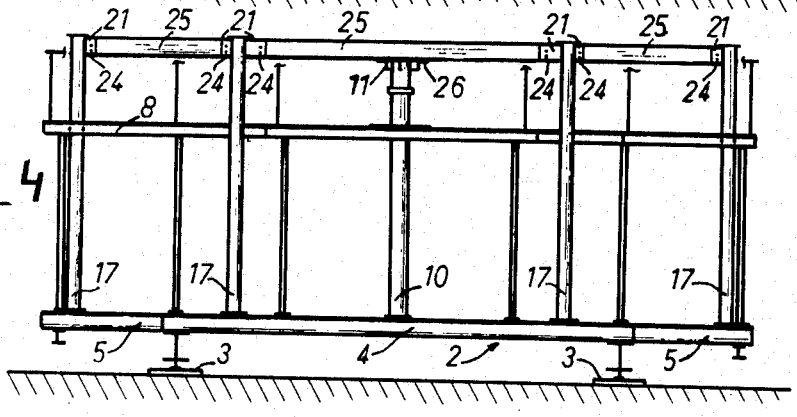
FIGS. 4 and 5 show the assembly of the edge beams connecting the skeleton supports in elevation and plan view.

After the skeleton supports 17 have been joined together by the edge beams 25, a hexagonal joining plate 26 (see FIGS. 4, 6), the "lower hub", is placed on the upper end of the supporting surface formed by the supporting wing 11. In this case the supporting wings 11 can serve as an orientation device and interact with recesses and/or projections of the lower hub 26 to align said hub in the correct position. Similar to the joining wings 21, 22 the lower hub 26 is furnished with holes for inserting bolts or rivets in a manner which will be described later. As an orientation device for the lower hub 26, instead of the supporting wing 11 other devices, such as a plate of the same outline with slightly raised edges accommodating the wing or orientation pins accommodating its contours, can be foreseen.

Figure 6:
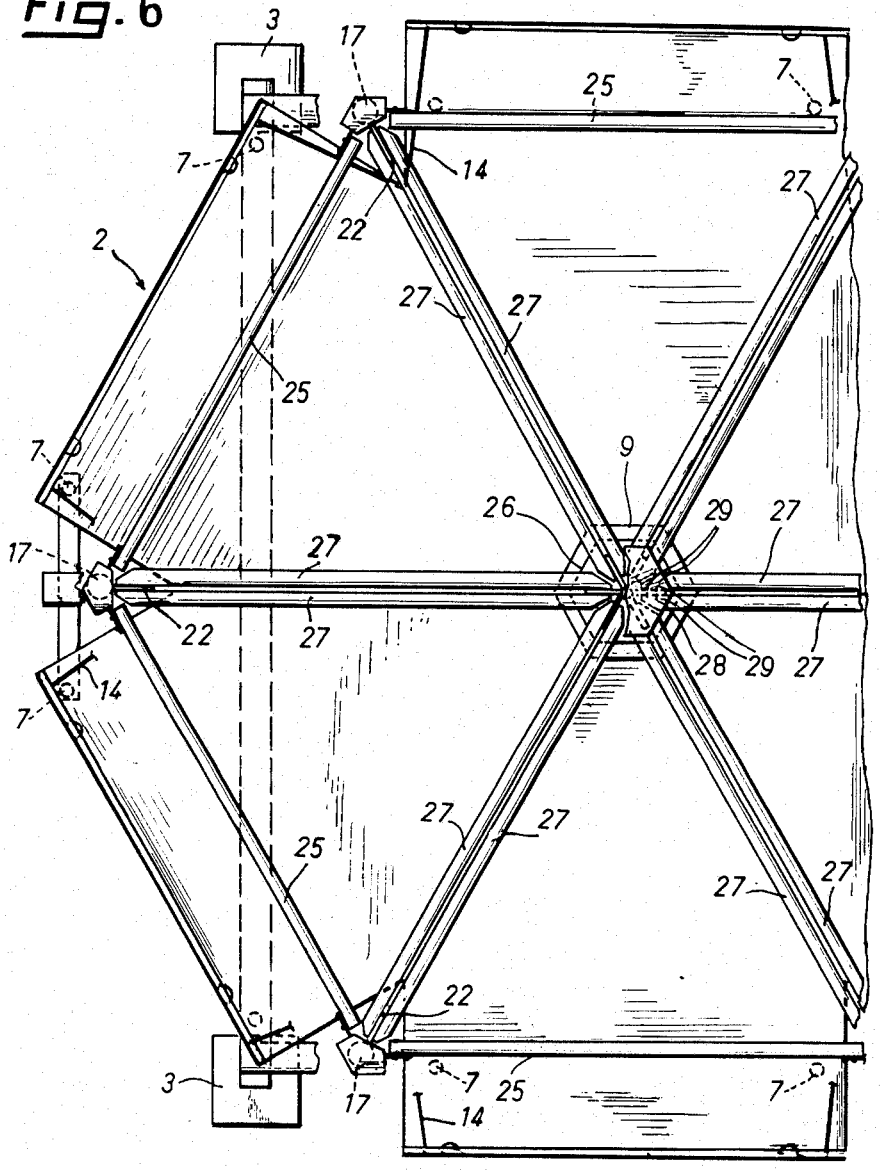
FIG. 6 shows the assembly of the radially extending ceiling beams, partially cut away.

Then the ceiling beams 27 are placed in pairs with one end on the lower hub 26, thereby being supported by the mast 10, while their other end is fastened to the joining wing 22 with bolts or rivets. As shown in FIG. 6 the ends of the ceiling beams 27 are furnished with a converging taper to facilitate erection.

The relationship of the plane of the lower edge of the joining wings 22 to that of the upper edge of the supporting wings 11 is derived from the foregoing. These two planes have just such a difference in height that the lower hub 26 finds room between them (see FIG. 4).

As soon as all ceiling beams 27 are fastened to their associated joining wings 22 of the supports, an upper hub 28 is placed upon them such that its holes 29 align with corresponding bores in the ends of the ceiling beams 27 and in the lower hub 26, whereby all these parts can be joined together with rivets or bolts. In the case of a bolting connection all bolts are retightened a second time and assembly is completed. Now the preassembled skeleton cell can be lifted as shown in FIG. 7 with a crane 30 (which also lifts the edge and ceiling beams 25 or 27 during assembly) and a three-arm hoisting apparatus 31 and joined to the skeleton of the skeletal high building 1. There the position of the skeleton cell is given exactly by the bolts poured in the foundation, and by the position of the already erected cells, so that the actual erection process consists merely of setting down the skeleton cell. The bearing and base plates are bolted together and the erection process is completed.

Since depending on the size of a building this erection process is repeated in exactly the same manner from 10 to a few hundred times, it is understandable that a number of advantages result from the process according to the present invention and the framework jig thereby used, such as:

Because of the assembly platform 8 the personnel can perform the fastening work at the height with is technically correct for such work.

The erection platform 8 is protected by the railing 13, 14, so that accident hazard is reduced to a minimum.

The main work for the erection of a building is performed on the ground or on the assembly platform 8, and not as is usual at the storey height, whereby the accident hazard is also reduced.

The position of the structural components is given exactly. The personnel need not remeasure, resulting in substantial time savings.

Since for the assembly of the edge and ceiling beams 25 or 27 hoisting tackle is not absolutely necessary, the crane 30 is needed only very shortly for assembly. The crane travel is also very short. This yields savings in time and costs.

The assembly speed for a steel skeleton consisting of cell elements can be increased almost at will by the simultaneous use of several framework jigs 2.

In all, these advantages also result in substantial cost savings.

Figure 8:
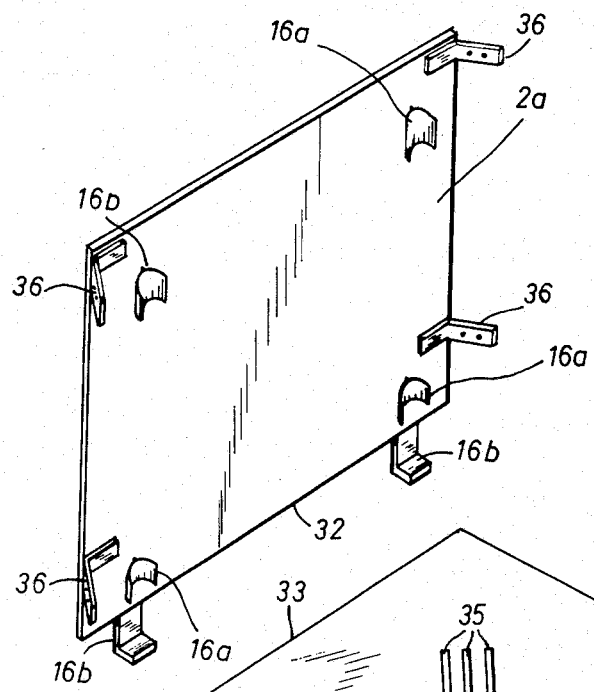
FIGS. 8 and 9 show two two-dimensional framework jig for assembling the skeleton of a cell element.
Figure 9:
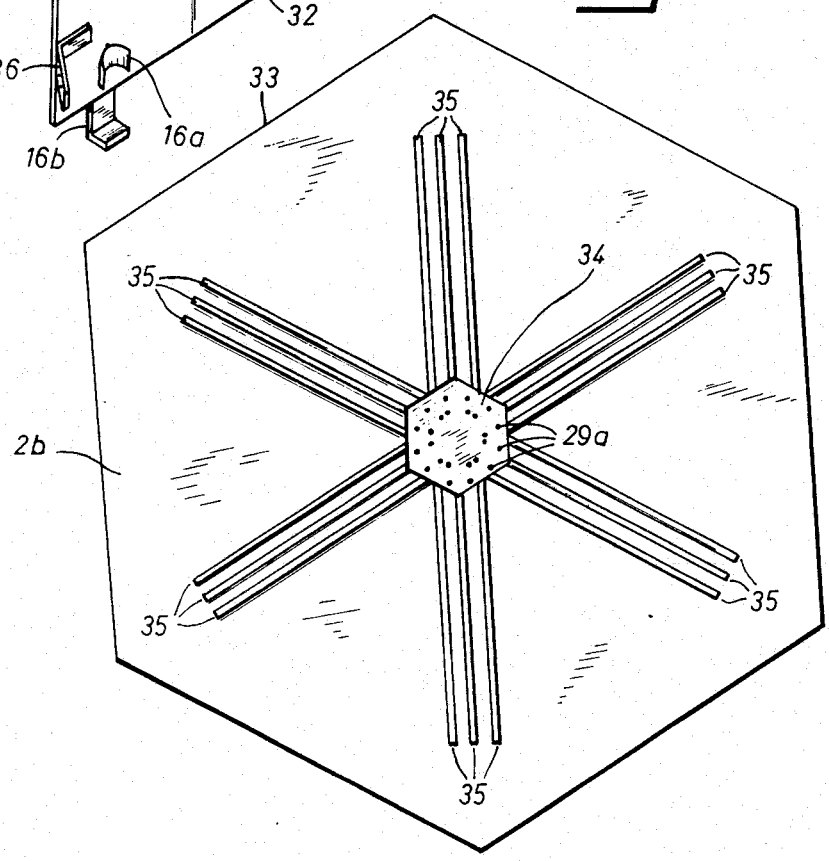

Although the embodiment example described above is preferred, it will be shown using the embodiments according to FIGS. 8 and 9 that a jig according to the present invention can also be configured two-dimensionally for the same purpose, even if the working conditions are not quite as favorable as with the embodiment described above. In this case a jig **2*a* is used, which has holding clamps 16*a* as an orientation device each for a pair of skeleton supports 17 (see FIG. 3). Adjustable stops 16*b* can possibly serve to align the height of the support bases 18. If necessary the supports 17 can be fastened in the clamps 16*a*, and it is possible to arrange six such jigs 2*a* around a further jig 2*b* (FIG. 9) such that its lower edge 32 is parallel to one of the sides 33 of the jig 2*b*. In this manner the six plates 2*a* are located in a plane around the jig 2*b*. Here, the supports 17 can now be inserted simultaneously into the clamps 16*a*, while the lower hub 26 (see FIGS. 4, 6) is inserted in a centered recess 34 in the jig 2*b*. Orientation devices each for a pair of ceiling beams 27 (see FIG. 6) are provided by strips 35, the width of the middle of the three strips 35 corresponding to the width of the joining wing 22 (FIG. 6). After the lower hub 26 is installed, the ceiling beams 27 can therefore be inserted between the strips 35, whereupon the upper hub 28 is fitted and everything is bolted together. To secure the access to the bolt heads or nuts correspondingly large bores 29*a* are provided in the jig 26**.

Then the structure consisting of the ceiling beams 27 and the hub 26, 28 can be lifted with a crane. In turn the plates **2*a* with the attached skeleton supports 17 are also tilted up and, with the aid of joining braces at the side 36, the arms of which form an angle of 120 degrees, joined together such that the supports 17 take up that position which is also given by the formwork jig 2 according to FIG. 3. The structure which is held by the crane and which has been prefabricated with the aid of the jig 2*b* can be fastened to the supports 17, whereupon the jigs 2*a* are no longer necessary for further operations. The edge beams 25** can then be fastened e.g. by means of a small mobile assembly platform which moves from one fastening location to another and which permits working at the necessary height, or by using a lifting platform of known type. It can be seen however that in this case the fastening work cannot be conducted in such a simple manner as with the assembly platform.

In the scope of the invention numerously different embodiments are possible; hence, the process according to the present invention and a jig according to the invention can be used generally for assembling all types of skeletons, but especially for the floor plans common to cell elements. The process can be applied e.g. for the construction of individual bays for exhibitions or the like. In this case jigs can also be used only for parts of the skeleton, say only one of the jigs 2*a* or 2*b*. Furthermore the assembly platform 9 can have the form of a wide walkway extending around the framework jig 2 or the mast 10 of the framework jig. For cell elements of rectangular floor plan the ceiling can have ceiling beams of checkerboard arrangement to be supported by several masts of the like.

Figure 10:
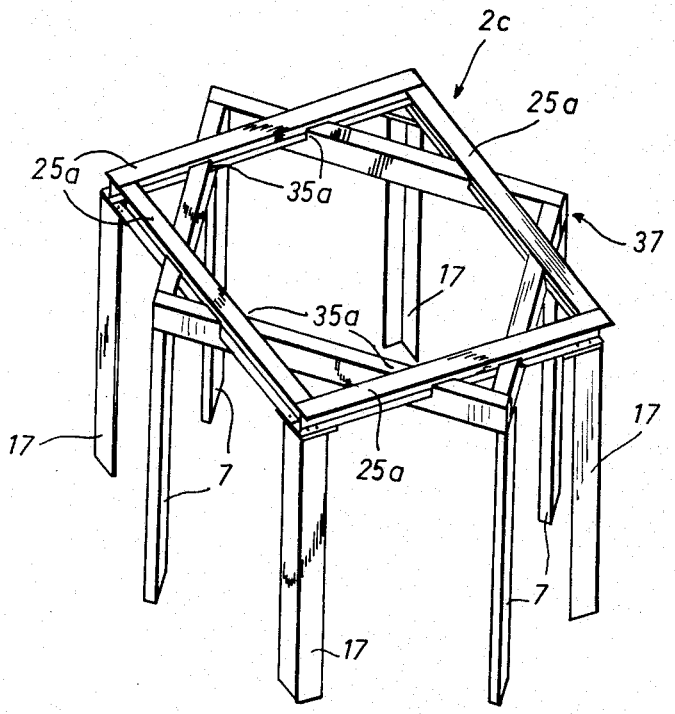
FIG. 10 shows a further embodiment of a three-dimensional framework jig in perspective view.

As resulting from the above description in the case of the jigs being configured according to FIGS. 1 to 7, with which primarily orientation devices 16 are foreseen for the supports 17, the assembly is started with the latter. In the case of FIGS. 8 and 9 the supports 17 and the radial beams 27 can be assembled or erected simultaneously or consecutively, simultaneous assembly resulting in a faster construction speed, but also a higher space requirement at the site which cannot always be fulfilled. On the basis of FIG. 10 a framework jig 2*c* is now explained, with which the ceiling beams are assembled before the supports, the same reference numbers as in the previously described figures being used for parts with the same function, possibly with the addition of an letter.

According to this embodiment a framework 37 is foreseen for the erection of the skelton of a cell element with rectangular floor plan on the framework support 7. For the assembly of edge beams 25*a* of the skeleton this framework 37 has orientation devices in the form of openings or recesses 35*a*, into which edge beams 25*a* are inserted at the beginning of assembly. Instead of openings 35*a* orientation strips 35 according to FIG. 9 can naturally also be used. Moreover, to facilitate assembly an assembly platform 8 not shown (see FIGS. 1, 2) is preferably foreseen, as the embodiment according to FIG. 10, if desired, can be combined with elements of the embodiment according to FIGS. 1 and 2, possibly also to erect cell elements of hexagonal or multi-angle floor plan.

The edge beams 25*a* are aligned in the openings 35*a* such that their ends can be joined together, whereby the corner points of the ceiling beam structure thereby ensuing, and therewith the connection points for the skeleton supports, 17 are determined. Said points can then be joined.

In the case of such a framework being used for a framework jig 8 according to FIGS. 1 and 2 the supports 17 can be erected at the same time as the ceiling beam structure is being made. Here, the framework can be configured such that it defines with its orientation devices the outer ends of the radial beams 27, while the mast 10 is foreseen for the inner ends. A framework 37 can also be used for assembling intersecting ceiling beams of a cell element of rectangular floor plan, said ceiling beams then extending diagonally across the ceiling between the edge beams 25*a*.

I claim:

1. A process for assembling a modular cell of a high building having a skeleton and consisting of a plurality of such cells which comprise self-supporting vertical skeleton support means having pin receiving holes and horizontal beam means having pin receiving holes matching the holes in the vertical skeleton support means which are pinned together by inserting pin means into respective matching holes, the process comprising the steps of:

arranging jig means;

orienting and securing at least said horizontal beam means on said jig means;

assembling said support means and said oriented beam means by inserting said pin means into said holes; and placing the cell, after being prefabricated in this way, onto the respective location of said building to be assembled by a plurality of such cells.

2. A process as claimed in claim 1, wherein said pin means comprise screw bolts.

3. A process as claimed in claim 1, wherein said pin means comprise rivets.

4. A process as claimed in claim 1, wherein said beam means comprise edge beams and radial beams of said cell, the process further comprising:

orienting and securing said skeleton support means on said jig means;

assembling said radial beams to a star-like configuration to be oriented on said jig means;

said step of assembling said support means and said oriented beam means including the assembly of said star-like configuration and thereafter said edge beams with said skeleton support means by inserting said pins into said holes.

5. A process as claimed in claim 1, wherein said beam means comprise edge beams and radial beams, the process further comprising:

orienting and securing said skeleton support means on said jig means;

said step of assembling said support means and said oriented beam means including the assembly first of said radial beams and then of said edge beams with said support means by inserting said pin means into said holes.

6. A jig for assembling a modular cell of a high building having a skeleton and consisting of a plurality of such cells which cover a cell surface and comprise self-supporting vertical skeleton support means having pin receiving holes and horizontal beam means having pin receiving holes matching the holes in the vertical skeleton support means; the said beams being pinned together by inserting pin means into respective sets of matching holes, said jig comprising:

first orienting means for supporting and holding said horizontal beam means in a predetermined position.

7. A jig as claimed in claim 6, wherein said first orienting means comprise vertical pole means having a top, and supporting wings within the range of the top, said pole means being arranged to support said horizontal beam means at the top in said predetermined position.

8. A jig as claimed in claim 6, wherein said first orienting means comprise means forming at least one groove for receiving said horizontal beam means.

9. A jig as claimed in claim 6, further comprising platform means, said first orienting means being arranged on said platform means.

10. A jig as claimed in claim 9, wherein said platform means extend substantially over the whole cell surface.

11. A jig as claimed in claim 9, wherein said platform means comprise guard means arranged around at least part of said platform means.

12. A jig as claimed in claim 6, further comprising second orienting means for securing and holding said vertical skeleton support means.

13. A jig as claimed in claim 12, wherein said second orienting means comprise peg means to be inserted into openings of said vertical skeleton support means.

14. A jig as claimed in claim 12, wherein said second orienting means comprise receiving means for surrounding part of said vertical skeleton support means.

15. A jig as claimed in claim 12, further comprising platform means, said second orienting means being arranged on said platform means.

16. A jig as claimed in claim 15, wherein said platform means extend subtantially over the whole cell surface.

17. A jig as claimed in claim 15, wherein said platform means comprise guard means arranged around at least part of said platform means.

* * * * *